United States Patent [19]

Page

[11] 4,252,176

[45] Feb. 24, 1981

[54] INJECTION RAM CONTROL

[75] Inventor: Enno H. Page, Toledo, Ohio

[73] Assignee: NL Industries, Inc., Hightstown, N.J.

[21] Appl. No.: 954,759

[22] Filed: Oct. 26, 1978

[51] Int. Cl.[3] ..... B22D 17/32

[52] U.S. Cl. ..... 164/155; 164/4; 164/312; 425/145

[58] Field of Search ..... 164/4, 154, 155, 159, 164/312; 425/145, 381

[56] References Cited

U.S. PATENT DOCUMENTS

| | | | |
|---|---|---|---|
| 2,811,758 | 11/1957 | Holmes et al. | 164/154 |
| 3,189,849 | 6/1965 | Tellerman | 333/30 |
| 3,225,312 | 12/1965 | Tellerman | 331/157 |
| 3,246,209 | 4/1966 | Multari et al. | 317/142 |
| 3,600,638 | 8/1971 | Ward | 317/141 S |
| 3,726,334 | 4/1973 | Sallberg | 164/155 |
| 3,729,047 | 4/1973 | Bohnlein et al. | 164/4 X |
| 3,767,339 | 10/1973 | Hunkar | 164/154 X |
| 3,888,388 | 6/1975 | Mahoney | 425/145 X |
| 3,893,792 | 7/1975 | Laczko | 164/155 X |
| 3,898,555 | 8/1975 | Tellerman | 324/34 D |
| 4,027,233 | 5/1977 | Shmakov et al. | 324/34 R |
| 4,029,458 | 6/1977 | Kim et al. | 425/DIG. 33 |
| 4,047,558 | 9/1977 | Kotthoff et al. | 164/155 X |
| 4,050,503 | 9/1977 | Balevski et al. | 164/155 |
| 4,066,189 | 1/1978 | Toyoaki et al. | 164/155 X |

FOREIGN PATENT DOCUMENTS

| | | | |
|---|---|---|---|
| 2236421 | 2/1973 | Fed. Rep. of Germany | 164/155 |
| 2302175 | 5/1974 | Fed. Rep. of Germany | 164/155 |

OTHER PUBLICATIONS

"Series DCTL Precision Continuous Liquid Level Sensor System", *New Products Bulletin,* Tiempo Instrument Incorporated, New York.

"Whispers On The Wire Measure Distance", *Newsreports, Feb. 1974.*

*Primary Examiner*—Robert D. Baldwin

*Assistant Examiner*—Gus T. Hampilos

*Attorney, Agent, or Firm*—Fitzpatrick, Cella, Harper & Scinto

[57] ABSTRACT

In a casting machine using an injection ram, the ram movements are measured accurately and reliably in spite of adverse ambient conditions by a special sensing arrangement located inside the hydraulic drive cylinder which drives the ram. A sonic energy pulse is generated in a waveguide near the hydraulic piston. This pulse propagates along the waveguide to a transducer at the cylinder wall. The time required for this pulse propagation corresponds to the position of the piston and hence of the injection ram.

14 Claims, 8 Drawing Figures

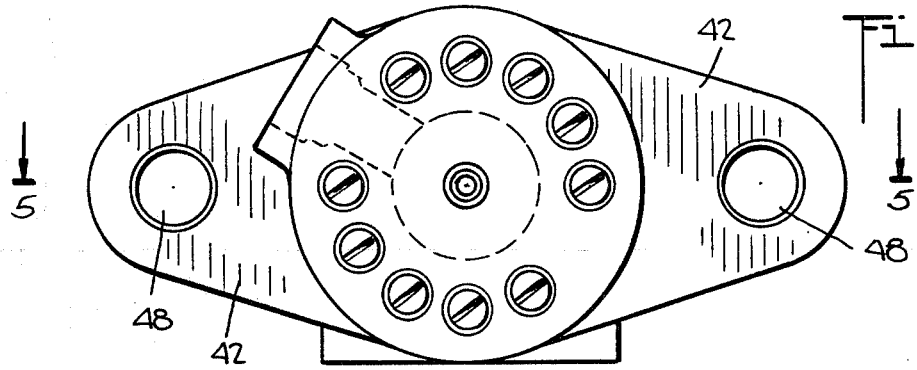
Fig. 4.
Fig. 6.
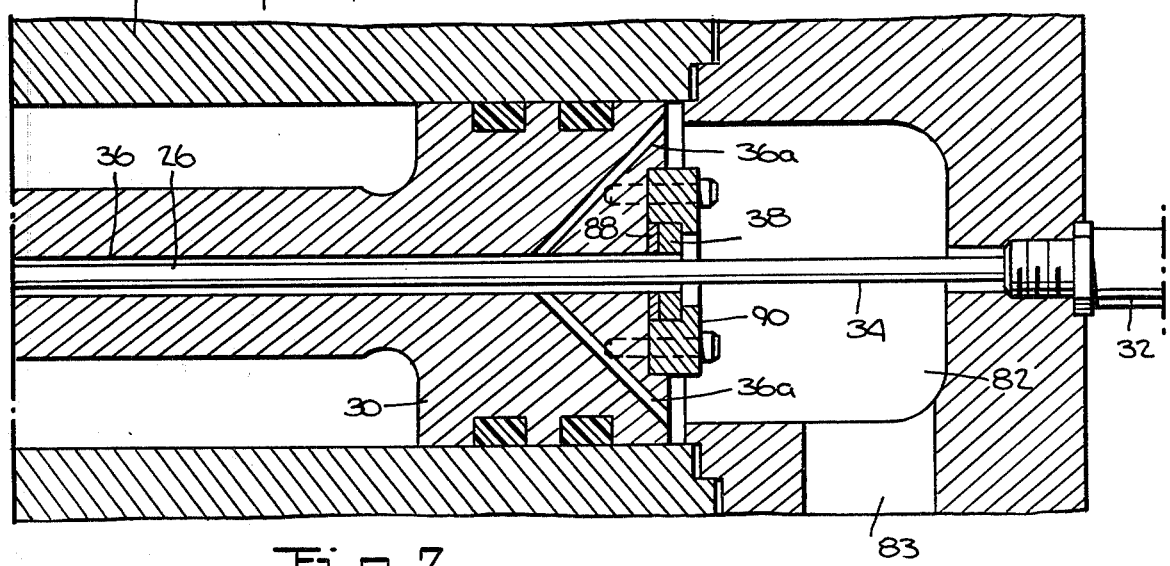
Fig. 7.
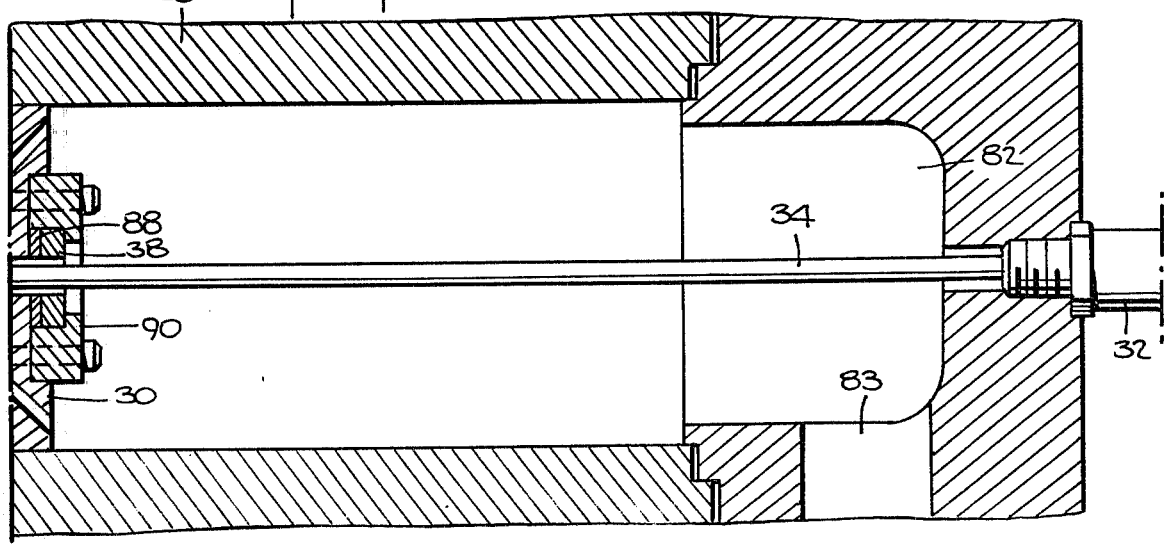

INJECTION RAM CONTROL

BACKGROUND OF THE INVENTION

1. Field of the Invention

This invention relates to hydraulically driven machinery and more particularly it concerns novel arrangements for monitoring and controlling the movement of hydraulically driven injection rams.

2. Description of the Prior Art

The present invention is particularly suitable for use with die casting machines. In these machines a fluid material to be cast, e.g. molten aluminum, is loaded, e.g. by ladling, into a shot sleeve which is connected to a die casting cavity. A hydraulically driven ram then moves rapidly through the shot sleeve to force the molten material into the die cavity. The molten material is chilled by contact with the cavity surfaces and hardens. Thereafter the cavity is opened and the hardened material is removed.

It is important in die casting operations to control the rate of material injection into the mold with a high degree of precision. If the injection speed is too great the material may wear the cavity surfaces and may produce bubbles in the finished castings. If the injection speed is too slow the material will cool improperly in the mold and will result in unacceptable castings. It is also advantageous to vary the injection rate as the cavity filling operation proceeds. This variation in injection rate will correspond to the particular size and shape of the cavity being filled; and accordingly it is desirable to provide a high degree of flexibility in the injection operation.

A number of techniques have been employed in the past to monitor and control the speed of injection of material into a mold cavity. U.S. Pat. Nos. 3,726,334 and 3,729,047 show arrangements for monitoring injection ram velocity and position. U.S. Pat. No. 3,726,334 suggests the provision of magnetic or mechanical elements along the length of the ram and a magnetic or optical sensing means fixed along the path of movement along the elements. As each element passes the sensing means it causes an electrical pulse to be generated. Ram position can be ascertained from the number of pulses which have occurred and ram or injection velocity can be ascertained from the rate at which the pulses occur. In U.S. Pat. No. 3,729,047 a plurality of glass filaments are arranged in a line along the path of ram movement and rays from a light source pass through the filaments. A light reflector is mounted to move with the ram and to pass by the ends of the filaments. As the reflector passes by each filament it redirects light through another filament to a photocell which generates an electrical pulse. Again, the number of pulses corresponds to ram position and the rate of occurrence of pulses corresponds to ram velocity.

U.S. Pat. Nos. 3,767,339, 3,893,792 and 4,066,189 show hydraulically driven injection molding devices with pressure sensing arrangements to control ram movements. U.S. Pat. No. 3,767,339 also shows a rack and pinion tranducer arrangement for monitoring the ram movements.

The position and velocity sensing devices of the prior art have not been entirely satisfactory for injection molding operations. This is because the ambient conditions in the vicinity of the ram are not conducive to precision measurement. More particularly, the material being molded often spills and contaminates the sensing or signal generating elements. Also, the dust, dirt and gases which accompany the feeding of molten material into the shot cylinder may interfere with the reliable operation of the sensing and signal generating elements.

SUMMARY OF THE INVENTION

The present invention provides an accurate and reliable measure of the position and velocity of a hydraulically driven ram under very adverse ambient conditions. According to the invention a position sensing device is provided inside the hydraulic system to measure movements of the hydraulic piston inside its cylinder. These movements correspond directly to the movements of the injection ram. In a specific embodiment, a generating means is provided to generate energy pulses which propagate along a guide means between the piston and a receiver or transducer located at the end of the hydraulic cylinder. The length of time required for these energy pulses to travel between the end of the piston and the hydraulic cylinder corresponds to the distance between them. Also, the difference between successive distance measurements corresponds to the velocity of the piston.

In a preferred embodiment an elongated sonic waveguide extends axially along the interior of the hydraulic cylinder and projects into an elongated axial bore in the hydraulic piston. The waveguide is fixed at one end to a transducer which projects through the end wall of the cylinder. A magnetic washer is mounted on the end of the piston to surround the waveguide and to move along the waveguide as the piston moves back and forth in the cylinder. The transducer is electrically connected to cause the washer to induce sharp torsional stresses in the adjacent portion of the waveguide and these torsional stresses propagate, as sonic pulses, along the waveguide to the transducer which converts them back to electrical signals.

Because the transducer and sonic waveguide arrangement is arranged to operate within the hydraulic system, it is completely isolated from the contaminating influences of the external atmosphere. Accordingly an accurate and reliable measurement of piston and ram movements can be obtained under very adverse conditions.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

Selected embodiments of the invention have been chosen for purposes of illustration and description, and are shown in the accompanying drawings, forming a part of the specification, wherein:

FIG. 4 is an end view of the hydraulic ram drive of FIG. 3;

FIG. 6 is an enlarged fragmentary view of a portion of FIG. 5 showing in detail a hydraulic piston and position sensing transducer arrangement employed therein;

FIG. 7 is a view similar to FIG. 6 but showing the hydraulic piston in a different position.

DETAILED DESCRIPTION OF THE PREFERRED EMBODIMENT

Figure 1:
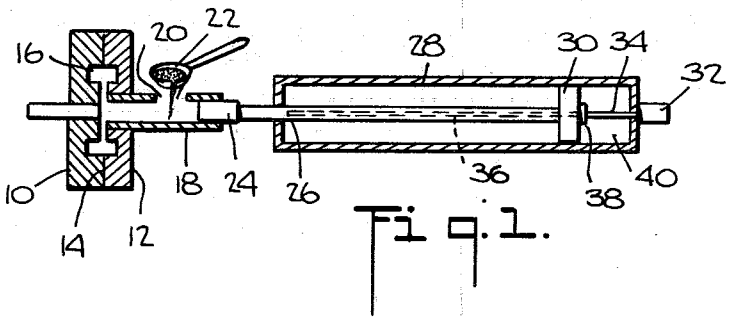
FIG. 1 is a diagramatic section view of hydraulically driven die casting machine in which the present invention is employed.
Figure 2:
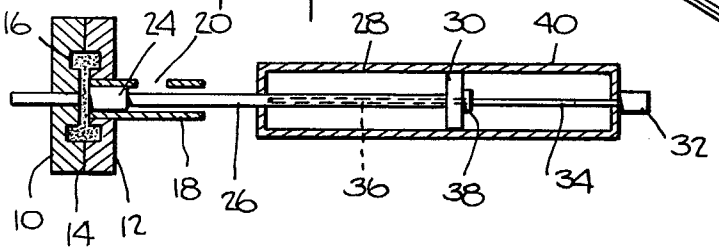
FIG. 2 is a view similar to FIG. 1 but showing the die casting machine at a different stage of actuation.

The die casting machine of FIGS. 1 and 2 comprises a pair of die parts 10 and 12 which fit together along a parting line 14, and which, when so fitted together, define a cavity 16. At least the forwardmost die part 10 is moveable away from the die part 12 to permit ejection of a part formed in the cavity 16. The cavity 16, in turn, communicates through the die part 12 with a shot sleeve 18. The shot sleeve is provided with a pour hole or opening 20 along its upper surface and molten material to be cast, e.g. molten aluminum, is poured, as from a ladle 22, through the pour hole 20 and into the sleeve 18.

A ram 24 is fitted to move back and forth inside the sleeve 18 from a retracted position (FIG. 1) behind the pour hole 20, to a projected position (FIG. 2) beyond the pour hole and near the cavity 16. The ram 24 is mounted on one end of a piston rod 26 which extends out from a ram drive cylinder 28. A piston 30 located on the opposite end of the piston rod 26 fits closely inside the cylinder 28 and is moved back and forth inside the cylinder by hydraulic supply means (not shown).

In operation of the die casting machine of FIGS. 1 and 2 the ram 24 is first retracted to the right, back away from the pour hole 20 by means of the piston rod 26. This is achieved by evacuating hydraulic fluid from a drive chamber 40 formed by the portion of the cylinder 28 behind or to the right of the piston 30. With the ram 24 thus retracted, molten metal to be cast is ladled through the pour hole 20 and into the shot sleeve 18. When the proper amount of molten material has been placed in the shot sleeve, hydraulic fluid is forced into the drive chamber 40 to force the piston 30 to the left. This movement is communicated via the piston rod 26 to the ram 24 and the ram in turn moves forwardly (i.e. to the left), past the pour hole 20 toward the cavity 16 as shown in FIG. 2. In the course of this movement the ram 24 forces the molten material into the cavity so that it becomes completely filled. The molten material is cooled by the inner cavity surfaces and it quickly solidifies after which the die parts 10 and 12 are parted to permit the resulting solid cast product to be ejected. The die parts 10 and 12 are then brought together and the ram is retracted so that additional molten material may be deposited inside the shot sleeve for a subsequent casting operation.

In order to measure the movements of the ram 24, i.e. its displacement and velocity, during the injection operation there is provided a transducer 32 and an elongated sonic waveguide 34. The transducer 32 is fixed to and extends through the end of the hydraulic ram drive cylinder 28. The sonic waveguide 34 is fixed to the cylinder 28 to extend axially therein and it is connected to the transducer 32. The piston 30 and piston rod 26 are also provided with an elongated axial bore 36 into which the waveguide 34 extends. A washer shaped magnet 38 is fastened to the end of the piston 30.

As the piston 30 and piston rod 26 move back and forth in the cylinder 28 they carry the magnet 38 with them so that the magnet moves along the waveguide 34 which is fixed relative to the cylinder 28. The distance of the magnet from the transducer thus corresponds to the movement or displacement of the ram 24. This distance is measured, as will be explained more fully hereinafter, by launching sonic pulses by the magnetostrictive principle into the waveguide 34 at the magnet 38 and detecting them after they have propagated through the waveguide to the transducer 32. The length of time required for this sonic pulse propagation through the waveguide from the magnet 38 to the transducer 32 corresponds to the distance between them and hence to the displacement of the piston 30 in the cylinder 28.

Figure 3:
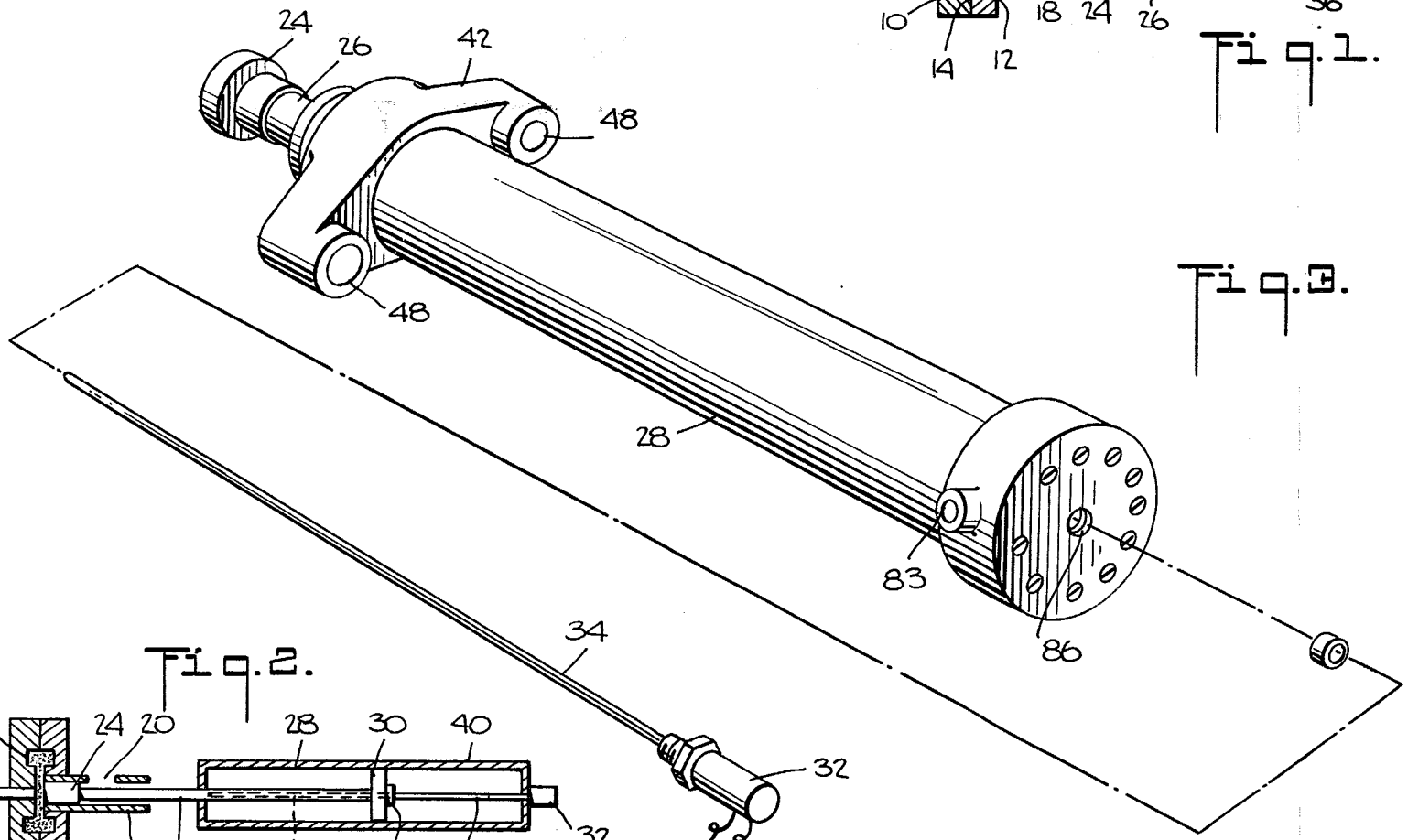
FIG. 3 is an exploded perspective view of a hydraulic ram drive forming part of the die casting machine of FIG. 1.
Figure 5:
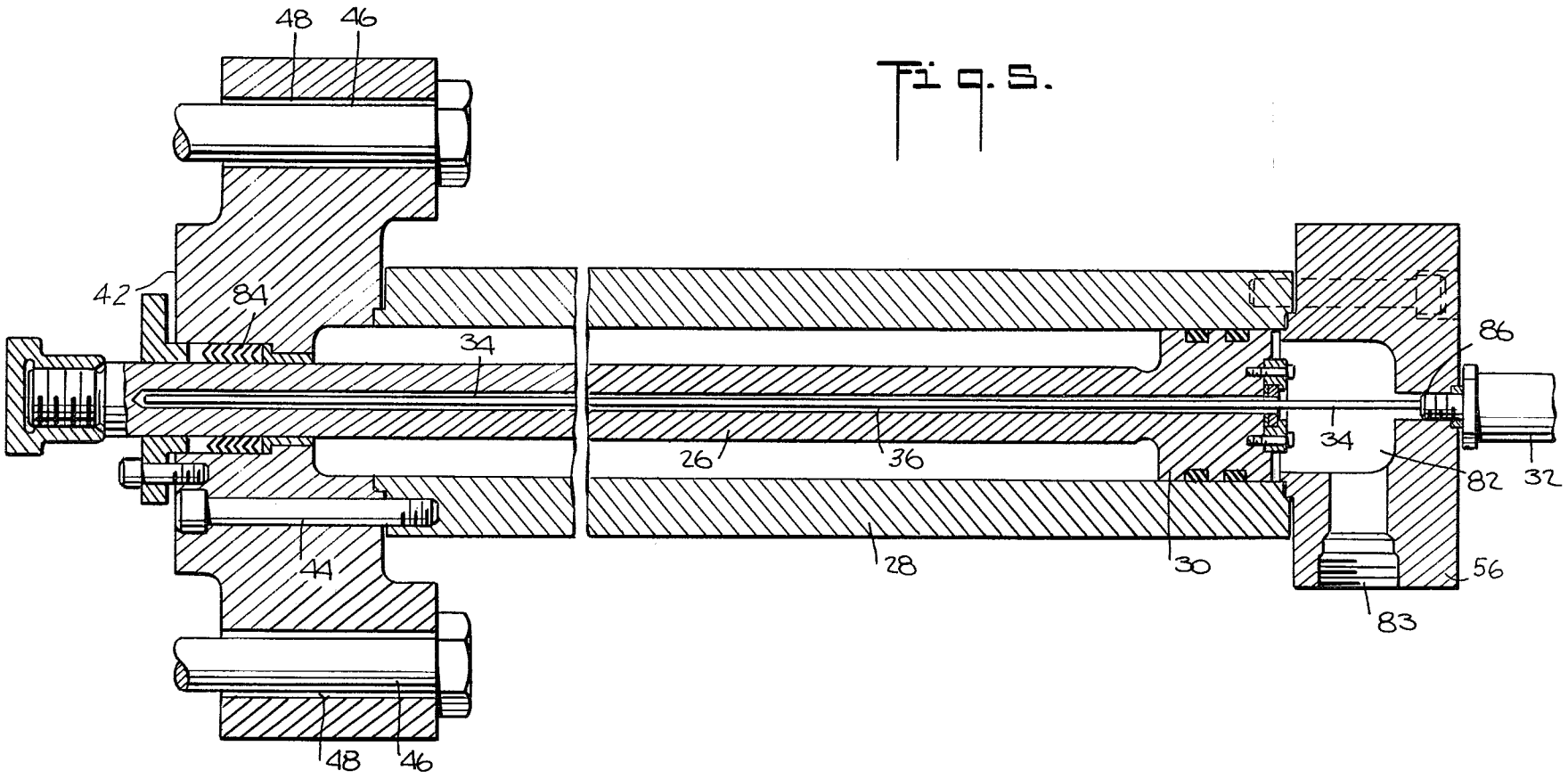
FIG. 5 is a section view taken along line 5—5 of FIG. 4.

The construction of the ram drive cylinder 28 and its associated equipment is shown in detail in FIGS. 3-7. As can be seen in FIG. 3 a cylinder mounting collar 42 is provided on the forward end of the ram drive cylinder 28 for securing the cylinder to the die casting machine. As can be seen in FIG. 5 cylinder bolts 44 secure the collar 42 to the cylinder 28 and collar bolts 46, which extend through holes 48 in the collar 42, hold the collar and the cylinder 28 to a mounting header on the die casting machine (not shown).

It can also be seen from FIG. 5 that the piston rod 26 is integral with the piston 30 in the ram drive cylinder 28 and that the piston rod extends through a forward sliding seal 84 in the mounting collar 42.

The transducer 32 is threaded into a threaded hole 86 (FIG. 3) in the end plate 56 axially of the ram drive cylinder 28 and the sonic waveguide 34 extends axially from the transducer inside the ram drive cylinder 28 and through the elongated axial bore 36 in the piston 30 and the piston rod 26. As can be seen in FIG. 5 the axial bore 36 is a blind hole and thereby communicates only with the end plate side of the piston 30. The bore 36 is of sufficient length to accommodate the waveguide 34 when the piston 30 is fully retracted as shown in FIG. 5; and at the same time the waveguide 34 is of sufficient length to remain partially inserted in the piston 30 when the piston is fully projected as shown in FIG. 2. Also, the bore 36 is of substantially larger diameter than the sonic waveguide 34. Thus, as the piston 30 and the piston rod 26 move back and forth along the ram drive cylinder 28 the sonic waveguide 34, which is fixed at the end plate 56 to the transducer 32 can slide easily in the axial opening. At the same time, fluid can flow easily in and out of the opening to accommodate the varying degrees of penetration of the waveguide 34 into the axial bore 36 as the piston 30 moves back and forth. By way of example, the opening 36 may be one-half inch in diameter (12.7 mm) while the sonic waveguide 34 may be three-eighths of an inch in diameter (9.52 mm). Also, to facilitate the movement of fluid into and out of the bore 36 there are provided a plurality of feeder bores 36*a* as shown in FIG. 6, which extend from the face of the piston 30 to the bore 36. These feeder bores 36*a* permit fluid to bypass the annular opening between the waveguide 34 and the magnet 38 and thus permit this opening to be very small. Thus the magnet 38 may be positioned extremely close to the waveguide 34 for maximum magnetic interaction and good signal production.

The magnet 38, which is in the shape of a washer surrounding the waveguide 34, is attached to the end of the piston 30 in a manner so as to isolate the magnet, magnetically, from the metal of the piston 30. To this end, as shown in FIGS. 6 and 7, there is provided an insulating washer 88, of some non-ferrous material, between the magnet and the piston; and the washer and the magnet are pressed against the end of the piston by means of a bracket 90 of brass or other suitable non-ferrous material.

The transducer 32, the sonic waveguide 34 and the magnet 38 form a known linear displacement measuring system operating on the magnetostrictive principle. Such systems are commercially available, for example from Tempo Instruments Incorporated, East Bethpage Rd., Plainview, N.Y., 11803; and they are described in U.S. Pat. No. 3,898,555. Essentially they operate by measuring the time required for a torsion strain pulse to travel along the waveguide 34 from the magnet 38 to the transducer 32. An electrical pulse is generated in the transducer and transmitted through a wire (not shown) which extends through the sonic waveguide. The circular magnetic field which surrounds the wire as a result of electrical current passing through it is distorted in the region of the magnet 38; and the distorted magnetic field imposes a finite torsional stress in the waveguide at the location of the magnet. This torsional stress, which, like the electrical signal producing it, is in the form of a pulse, travels along the waveguide 34 at a predetermined velocity. When the stress pulse reaches the transducer 32 it causes an electrical signal to be produced in the transducer. The time duration between the electrical signal which produces the torsion stress pulse at the location of the magnet and the electrical signal produced at the transducer when the torsion stress pulse reaches it corresponds to the distance between the magnet and the transducer. More specifically the distance between the magnet and the transducer is the product of the time interval between these two electrical signals and the torsion pulse propagation velocity along the waveguide. Suitable electrical pulse transmitting, detecting and timing means (not shown) are provided in association with the transducer 32 for carrying out the foregoing operations. Such electrical means are well known in the art.

In operation of the above described die casting machine, the ram 24 is first retracted, as shown in FIG. 1, so that molten aluminum or other casting material can be ladled or otherwise charged into the shot sleeve 18 via its inlet pour hole 20. At this time the die parts 10 and 12 are closed against each other and the cavity 16 is empty.

The ram 24 is held in this retracted position by the piston rod 26 and the piston 30, which are retracted into the ram drive cylinder 28, i.e. moved to the right as viewed in FIG. 5.

As the piston 30 moves to the left it carries the magnet 38 along with it. The movements of the magnet therefore correspond directly with the movements of the ram 24. The sonic waveguide 34, however, remains stationary relative to the ram drive cylinder 28. Accordingly the distance which the ram 24 and the piston 30 have moved corresponds to the distance along the sonic waveguide 34 between the magnet 38 and the transducer 32. This distance is measured as above described, by generating an electrical pulse signal in the transducer 32 at a first point in time so as to produce a corresponding torsional stress pulse in the waveguide at the magnet 38 located on the piston 30. This torsional stress pulse propagates along the waveguide 34 to the transducer 32 at the end of the cylinder 28 where it produces an electrical pulse at a second point in time. The duration between these points in time corresponds to the position of the magnet 38 along the waveguide and hence it represents the position of the piston 30 and of the ram 24. Piston and ram velocity is ascertained by making a series of such position measurements and indicating their change in time.

Figure 8:
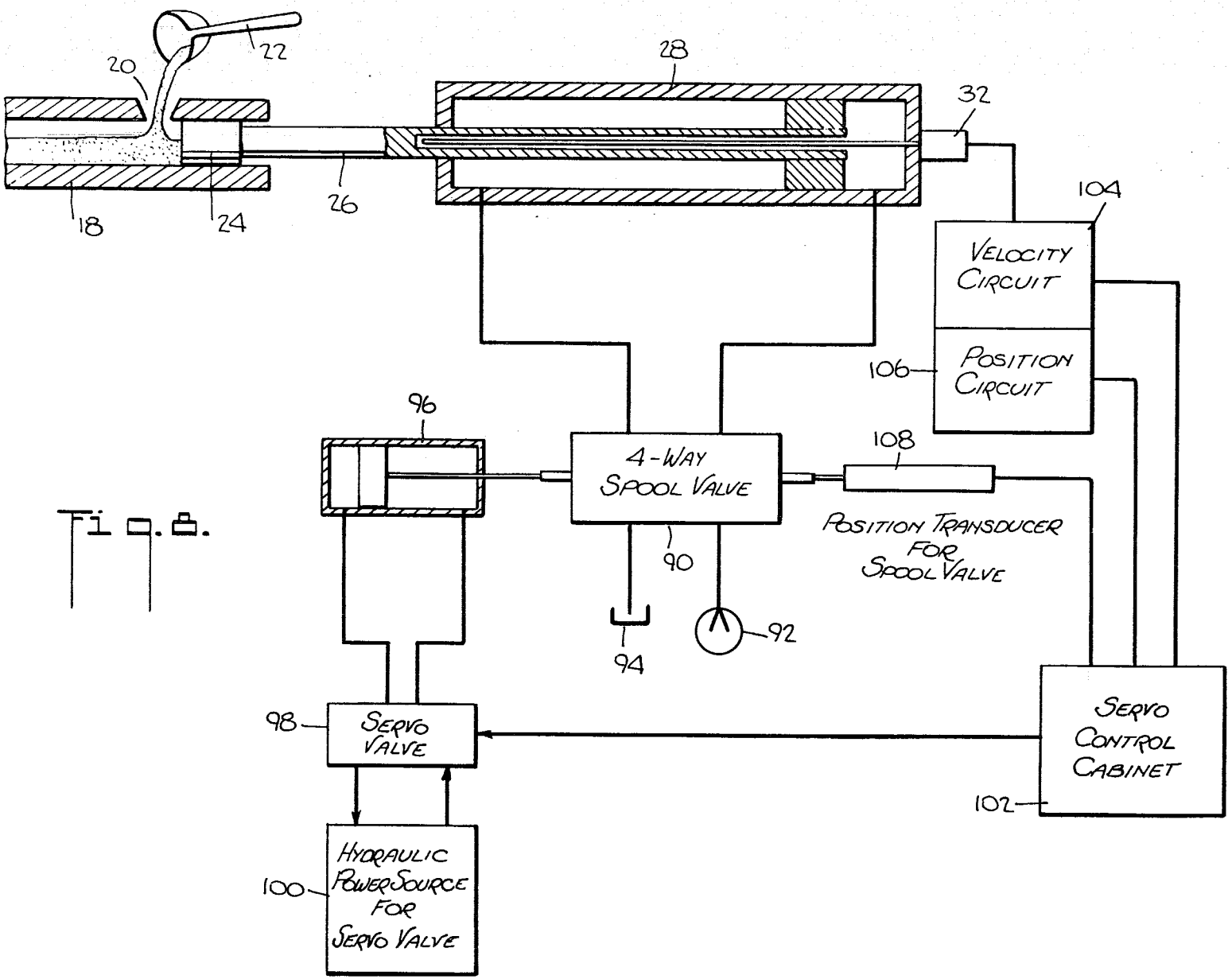
FIG. 8 is a schematic of a servo controlled die casting machine according to the present invention.

FIG. 8 shows an arrangement of the invention for providing automatic control of the ram velocity according to its position. As shown in FIG. 8 the ram drive cylinder 28 is connected via a four-way spool valve 90 to a hydraulic pump 92 and drain 94. A pilot cylinder 96 is connected to operate the spool valve 90 and the pilot cylinder is connected via a servo valve 98 to a hydraulic power source 100. The servo valve 98 is arranged to be operated, either mechanically or electrically from a servo control 102. The transducer 32 is connected to a velocity circuit 104 and a position circuit 106 which, as described in connection with the preceding embodiment, operates to produce signals representative of the position and velocity of the piston 30 and hence of the ram 24. These velocity and position signals are supplied to the servo control 102 where they are processed in conjunction with a predetermined velocity/position program. Thus the velocity of the ram at each position is compared with the programmed velocity for that position and deviations from the programmed velocity cause corresponding error signals to be produced. These error signals are compared with valve position signals representative of the position of the spool valve 90 to produce servo control signals which are applied to the servo valve 98. The servo valve in turn controls hydraulic actuation of the pilot cylinder 96 to adjust the spool valve 90 so as to increase or decrease the flow of hydraulic fluid to the ram drive cylinder and adjust the velocity of the piston 30. A position transducer 108 is arranged on the spool valve 90 to produce signals representative of its spool position for comparison with the error signals in the servo control 102. With the arrangement of FIG. 8 the velocity of the ram is automatically controlled throughout the ram stroke to follow a predetermined pattern according to the needs of the die casting machine.

It can be seen that the present invention provides accurate and continuous measurement of ram position and velocity during a die casting operation; and, because the transducer, waveguide and magnet are all enclosed within the hydraulic circuit itself these precision elements are isolated from the contaminating effects of the atmosphere in the vicinity of the die casting machine.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

We claim:

1. A ram injection machine comprising an injection mold, a shot sleeve in communication with said mold, an injection ram mounted to project into said shot sleeve to force molding material from said shot sleeve into said mold, a hydraulic drive for said ram, said hydraulic drive comprising a hydraulic cylinder and a piston mounted for movement therein, said piston extending out from said cylinder and connected to said injection ram to drive same into said shot sleeve, hydraulic fluid supply means arranged to supply pressurized hydraulic fluid to the interior of said hydraulic cylinder to move said piston and drive said ram and position sensing means located inside said hydraulic cylinder and arranged to measure movements of said piston in said cylinder, said position sensing means being connected to produce signals for use outside of said cylinder representative of said movements, said position sensing means comprising pulse transmitting means and pulse receiving means, one of said pulse transmitting and receiving means mounted on said piston inside said cylinder and the other mounted to said cylinder, so that as said piston moves in said cylinder, the spacing within said cylinder between said pulse transmitting and receiving means changes such that the length of time required for a pulse to travel between said pulse transmitting and receiving means corresponds to the distance between said pulse transmitting and pulse receiving means, means for indicating the transmission of a pulse from said pulse transmitting means and means for indicating the reception of said pulse by said pulse receiving means following its passage within said cylinder from said pulse transmitting means to said pulse receiving means.

2. A ram injection machine according to claim 1 wherein said position sensing means is immersed in the hydraulic fluid of said hydraulic cylinder.

3. A ram injection machine according to claim 2 wherein said position sensing means further includes guide means to guide said pulses between said pulse transmitting and receiving means.

4. A ram injection machine according to claim 3 wherein said guide means comprises an elongated waveguide which projects axially into said cylinder from one end thereof.

5. A ram injection machine according to claim 4 wherein said piston is formed with an elongated axial bore into which said waveguide projects.

6. A ram injection machine according to claim 5 wherein said pulse receiving means comprises a transducer which is connected to one end of said waveguide through an end wall of said cylinder.

7. A ram injection machine according to claim 6 wherein said waveguide is capable of transmitting torsional stresses, wherein said pulse transmitting means comprises a magnet and wherein said transducer is connected to send an electrical impulse along said waveguide so as to generate an electrical field around the waveguide which interacts with the magnet to produce a torsional stress in said waveguide at the location of said magnet.

8. A ram injection machine according to claim 7 wherein said magnet is in the shape of a washer surrounding said waveguide.

9. A ram injection machine according to claim 8 wherein said magnet is magnetically isolated from the piston.

10. A ram injection machine according to claim 5 wherein said elongated axial bore is in the form of a blind hole opening to the end of said piston and extending into said piston to a sufficient depth to accommodate said waveguide when said piston is fully retracted.

11. A ram injection machine according to claim 10 wherein said elongated axial bore is sufficiently greater in diameter than said waveguide to allow free movement of hydraulic fluid displaced by movements of said bore relative to said waveguide.

12. A ram injection machine according to claim 11 wherein at least one bypass bore interconnects said axial bore with the end of said piston away from said means for generating energy pulses.

13. A ram injection machine according to claim 1 wherein said position sensing means is arranged to produce a plurality of position and velocity signals during movement of said piston along a path corresponding to a ram injection stroke.

14. A ram injection machine according to claim 13 wherein said ram injection means includes hydraulic valve means for controlling the movements of said piston in said hydraulic cylinder and wherein said ram injection means further includes programmed control means responsive to said position and velocity signals to control said hydraulic valve means to maintain the velocity of said piston related to its position according to a predetermined program throughout the ram stroke.

* * * * *